US010662046B1

(12) United States Patent
Engebretson et al.

(10) Patent No.: US 10,662,046 B1
(45) Date of Patent: May 26, 2020

(54) BOOM-MOUNTABLE MATERIAL HANDLER

(71) Applicant: Altec Industries, Inc., Birmingham, AL (US)

(72) Inventors: Matthew S. Engebretson, Duluth, MN (US); Zachery Martin, Saint Louis, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 16/229,140

(22) Filed: Dec. 21, 2018

(51) Int. Cl.
*B66F 9/065* (2006.01)
*B66F 9/12* (2006.01)

(52) U.S. Cl.
CPC ..... *B66F 9/0655* (2013.01); *B66F 9/12* (2013.01)

(58) Field of Classification Search
CPC .. B66F 9/127; B66F 9/122; B66F 9/12; B66F 9/14; B66F 9/146; B66F 9/0655; B66F 11/044; B66F 11/046; B66F 11/048; B66F 7/22; E04G 1/22; B66C 1/22; B66C 23/04; B66C 23/701; B66C 23/702
See application file for complete search history.

(56) References Cited

U.S. PATENT DOCUMENTS 4,188,757 A 2/1980 Smith, Jr.
4,289,442 A * 9/1981 Stevens ..... B66F 9/10 414/629
4,632,630 A * 12/1986 Maki ..... B66F 9/0655 414/671
4,986,721 A * 1/1991 Lowder ..... B66F 9/061 414/667
5,577,878 A * 11/1996 Brown ..... B66F 9/0655 414/708
6,881,023 B1 * 4/2005 Sullivan ..... B66F 9/18 187/237
9,457,999 B2 10/2016 Belotti et al.
9,620,040 B2 * 4/2017 Kaytes ..... B65F 1/122
2001/0041123 A1 * 11/2001 Baumann ..... B62D 21/04 414/296
2004/0262079 A1 * 12/2004 Bailey ..... B66C 23/36 182/2.3
2005/0226710 A1 * 10/2005 Friedrich ..... B66C 1/24 414/663
2005/0254931 A1 * 11/2005 Gokita ..... B66F 9/0655 414/680

(Continued)

OTHER PUBLICATIONS

Jam Outdoor Another New site installed on FE walker st—May 30, 2017 https://www.facebook.com/JAMOutdoor/photos/pppbo.421402394736219/1506456296043512/?type=3&theater (Year: 2017).*

*Primary Examiner* — Glenn F Myers
(74) *Attorney, Agent, or Firm* — Erise IP, P.A.

(57) ABSTRACT

A boom-mountable implement for raising loads from below the load is described herein. The boom-mountable implement comprises at least on platform for supporting the load and is attachable to the boom by a quick-attaching adapter. The quick-attaching adaptor comprises a boom-interfacing segment and an implement-interfacing segment for quick and easy attachment of the boom to the implement. The boom-mountable implement raises loads from below allowing for the load to be secured quickly and efficiently in locations that would not otherwise be reachable by systems and methods attaching to the load from above.

20 Claims, 13 Drawing Sheets

(56) References Cited

U.S. PATENT DOCUMENTS

2008/0310946 A1* 12/2008 Allen ..... B66F 9/12
414/785
2013/0037348 A1* 2/2013 Romigh ..... B66F 9/125
182/63.1
2016/0161046 A1* 6/2016 Miles ..... B66F 11/046
182/141

* cited by examiner

BOOM-MOUNTABLE MATERIAL HANDLER

RELATED APPLICATIONS

Embodiments and/or features of the invention described in the present document may be used with subject matter disclosed in commonly assigned U.S. Non-Provisional patent application Ser. No. 14/564,381, filed Dec. 9, 2014, and entitled "AERIAL DEVICE WITH QUICK-COUPLING IMPLEMENT." The identified earlier-filed patent application is hereby incorporated by reference in its entirety into the present application.

BACKGROUND

1. Field

Embodiments of the invention relate to boom-mountable material handlers. More specifically, embodiments of the invention relate to a material-lifting device that is adapted to quickly couple to and decouple from an implement, such as a utility platform assembly, using a quick-coupling adapter.

2. Related Art

Utility and construction equipment is often utilized to move heavy signs. Cranes are frequently used to raise and lower the heavy signs for placement on sign posts at high locations so they have good visibility for marketing. When a gas station, restaurant, sporting venue, or any establishment that may use a sign for marketing or to present information needs a new sign or needs maintenance on a sign, the sign is typically moved using a crane. Workers may stand in an aerial device utility platform attach the crane to the sign that is mounted to an aerial structure and detach any fasteners connecting the sign to the structure that supports the sign. The sign may be one of many signs that may be detached. In many cases it is difficult for a crane to be used since the crane can only attach to the sign from above. If a sign needs to be replaced and that sign has a structure above it then the structure and other signs must be removed before the lower sign can be replaced. This is time consuming and requires more resources than would be required if the sign is raised from below.

What is needed is a device that connects to an aerial device that supports any signs or other aerial objects that may be lifted into a secure place supporting the signs or loads to be raised from below. Further, what is needed is a device that is easily transportable and provides quick attachment to reduce the time and resources required to perform maintenance, addition, or extraction of the aerial objects, signs, or general loads.

SUMMARY

Embodiments of the invention solve the above-mentioned problems by providing a device for raising and lowering aerial mounted objects such as signs, which may be generally referred to herein as loads, with support from under the load. A material handler or any configuration of an aerial device dependent on the load to be raised is attached directly to a boom, to an intermediate attachment device, and/or to a utility platform. The load may then be attached to the material handler. The material handler may then be used to support the load while the material handler and the load are raised to a desired location. The load may be supported by the material handler from below. This allows the load to be lifted into position and attached to a supporting structure when overhead obstacles are present.

A first embodiment of the invention is directed to a boom-mountable implement for supporting and raising a load comprising at least one platform for supporting the load from below, wherein the platform is configured to attach to a carriage supporting the platform, and an adapter for attaching the carriage to a boom, wherein the adapter comprises a boom-interfacing segment attached to the boom, and an implement-interfacing segment attached to the carriage, wherein the boom-interfacing segment comprises at least one attachment for attaching to the implement-interfacing segment.

A second embodiment is directed to a method for raising a load using a boom-mountable implement, the method comprising the steps of inserting a boom-interfacing segment attached to a boom into a recess of an implement-interfacing segment attached to the implement, wherein the implement comprises forks for supporting a load from below, securing the load on the forks, raising the implement using the boom, securing the load to a structure separate from the implement, and releasing the load from the implement.

A third embodiment is directed to a boom-mountable implement for supporting and raising a load comprising, a platform for supporting the load from below, wherein the platform is configured to attach to a utility platform, wherein the platform is configured to be adjustable to receive and support the load, wherein the utility platform is configured to be raised by a boom such that the load is raised to a particular height.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 6A:
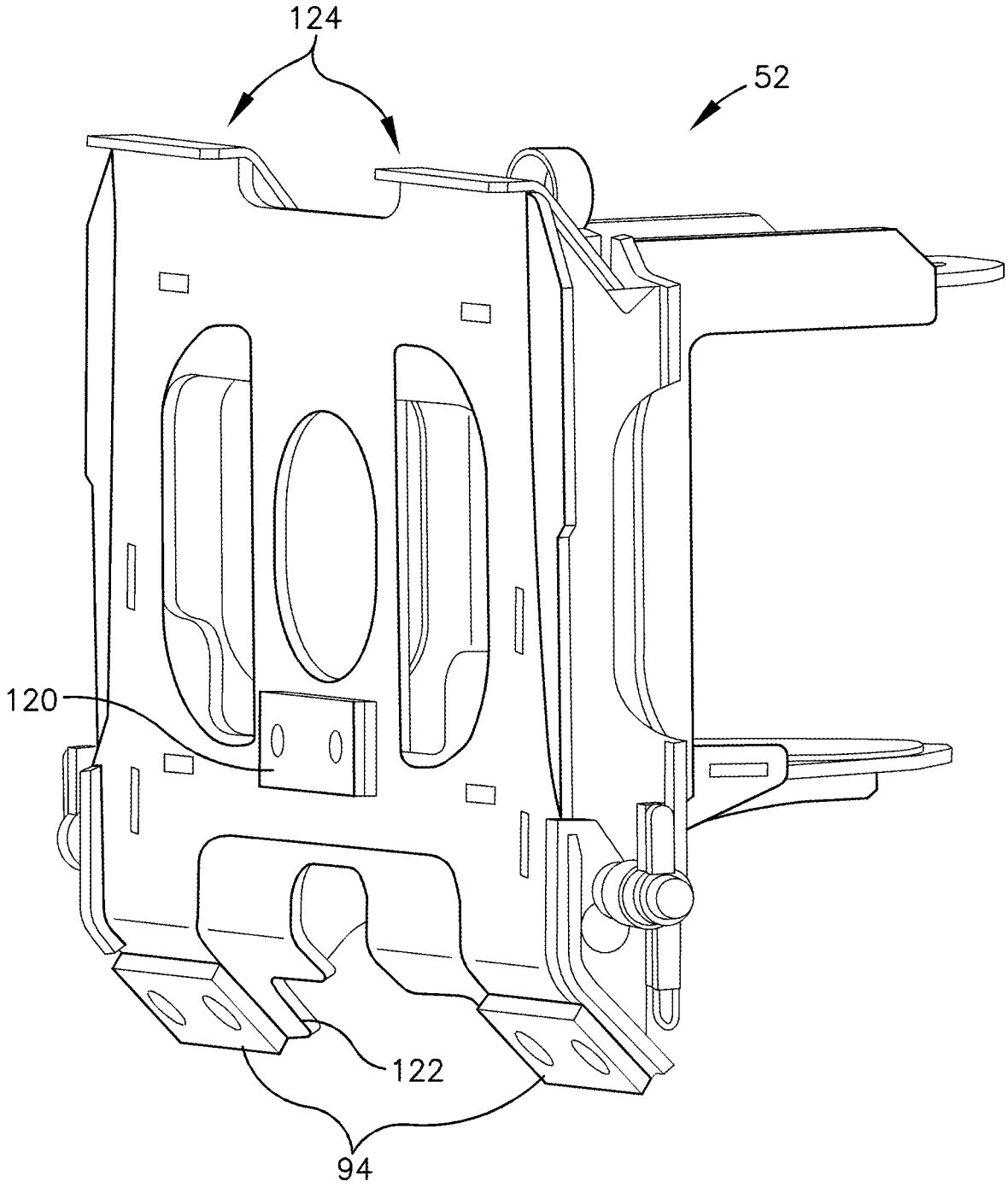
Figure 6B:
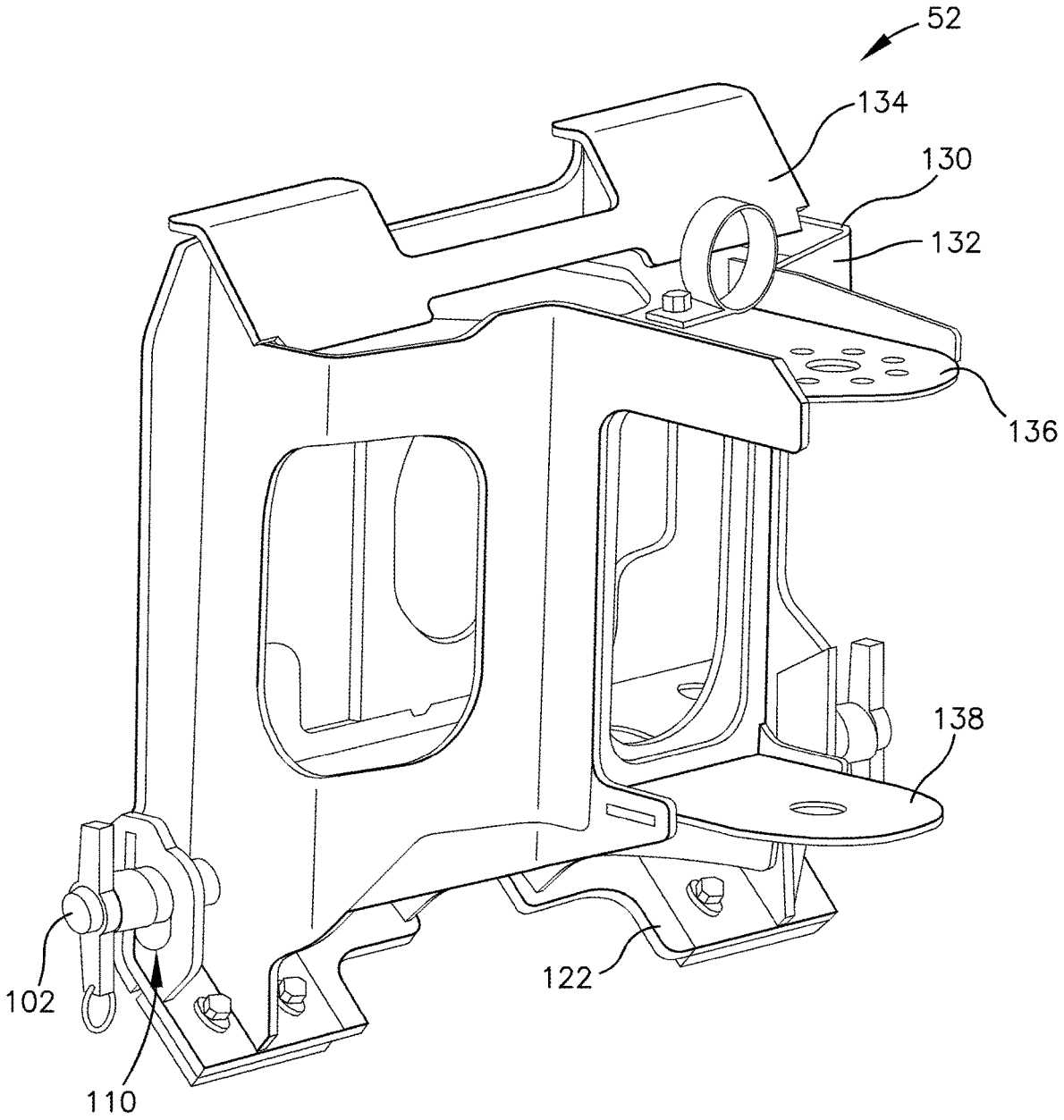
Figure 7A:
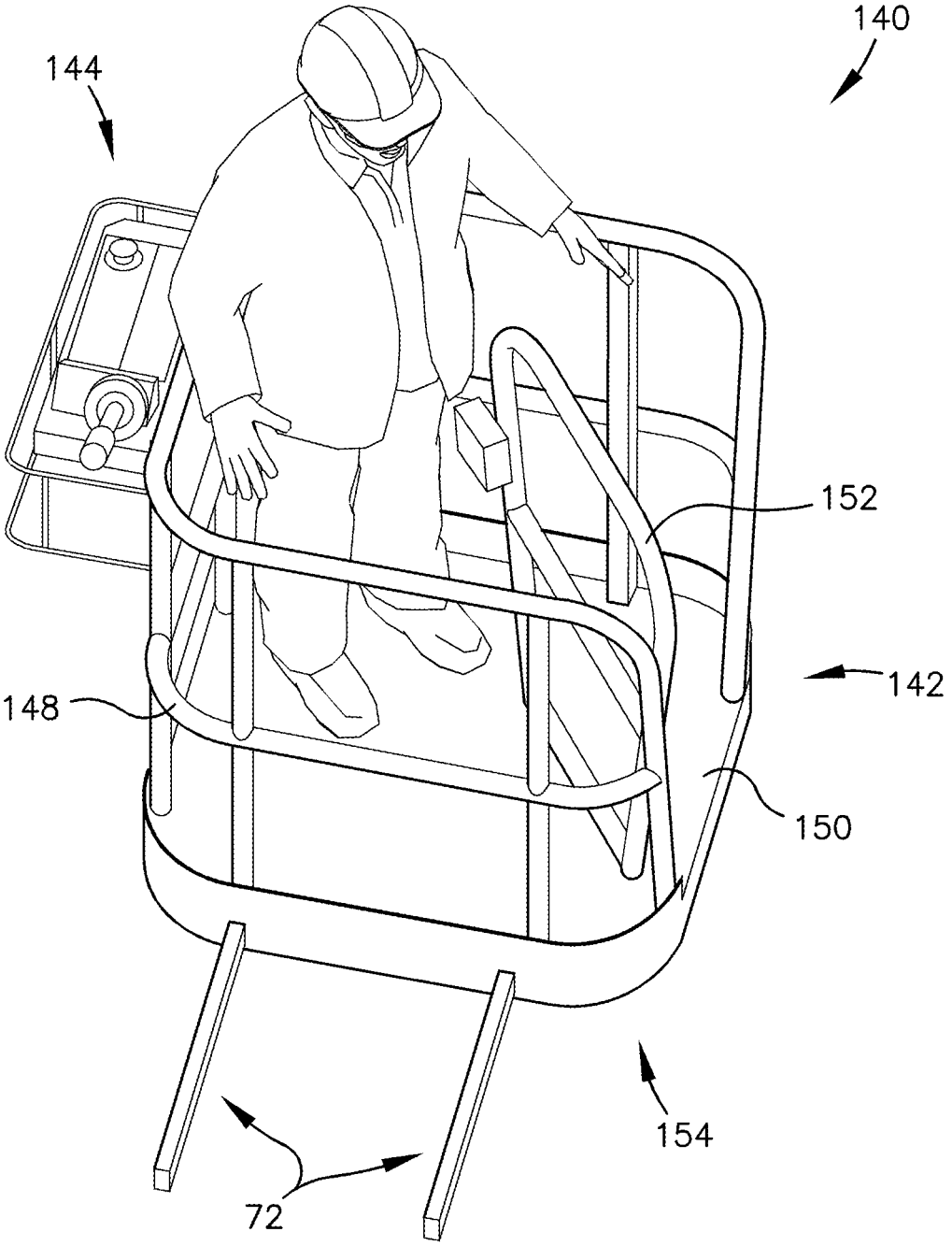
Figure 7B:
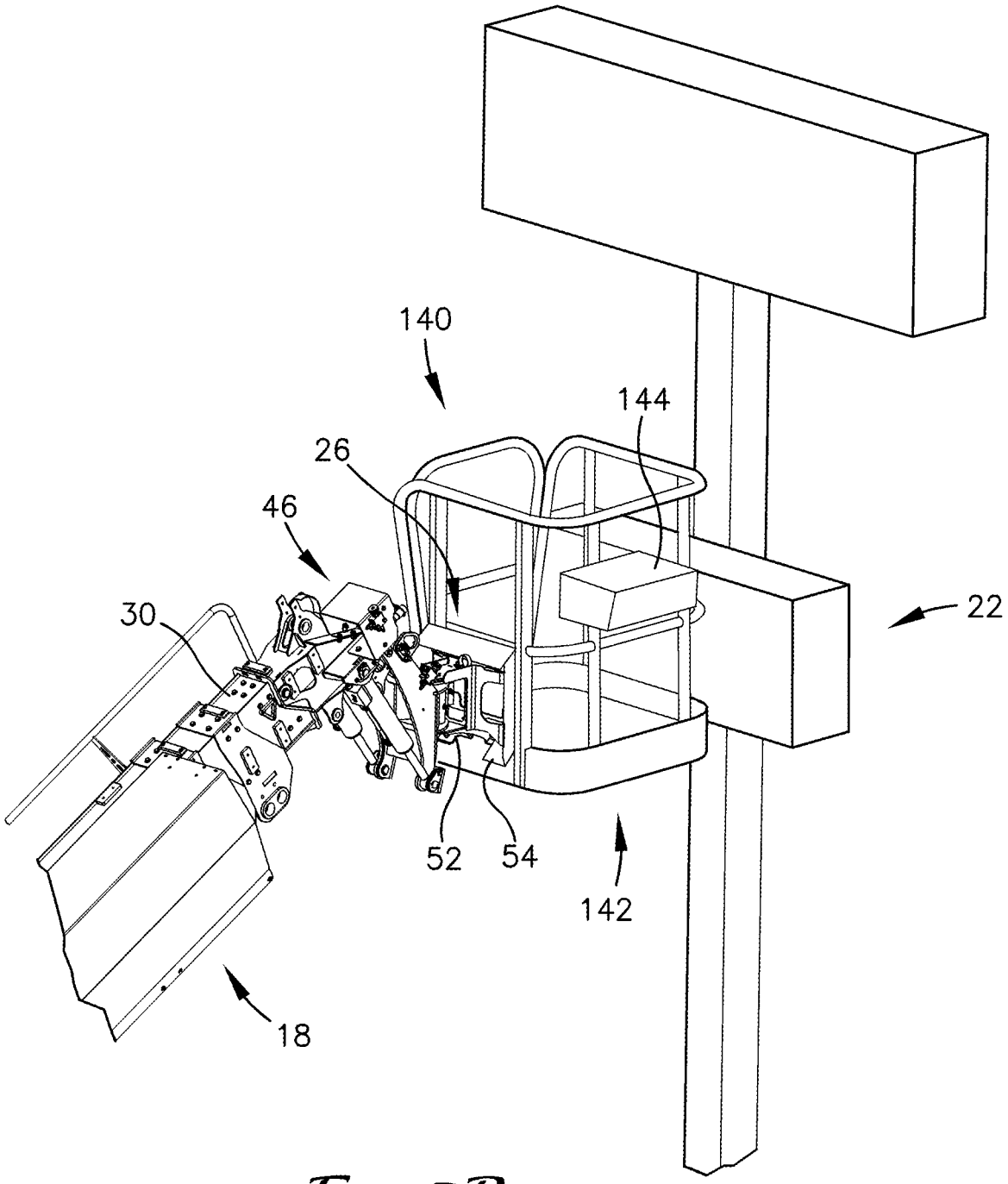
Figure 8A:
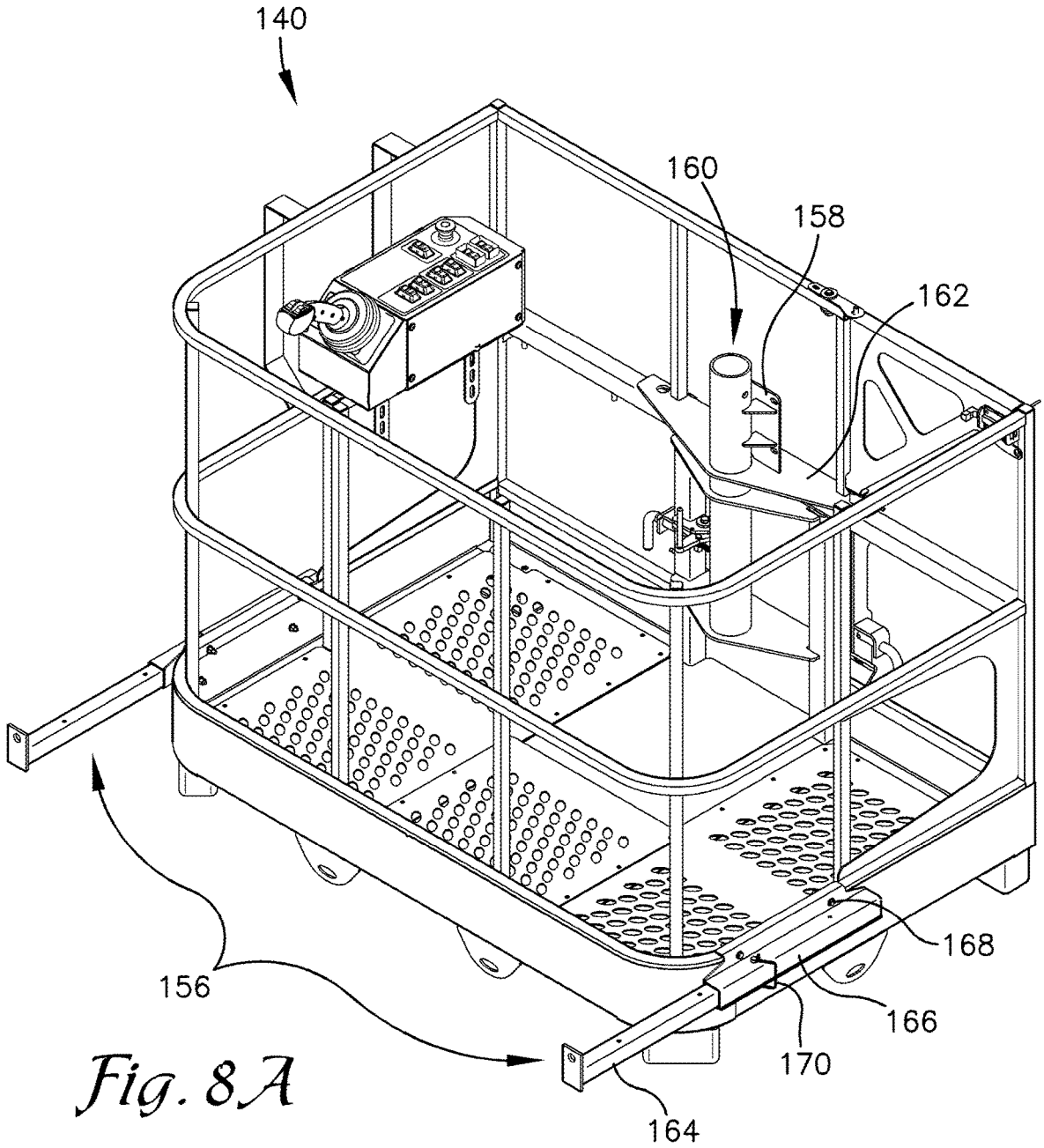
Figure 8B:
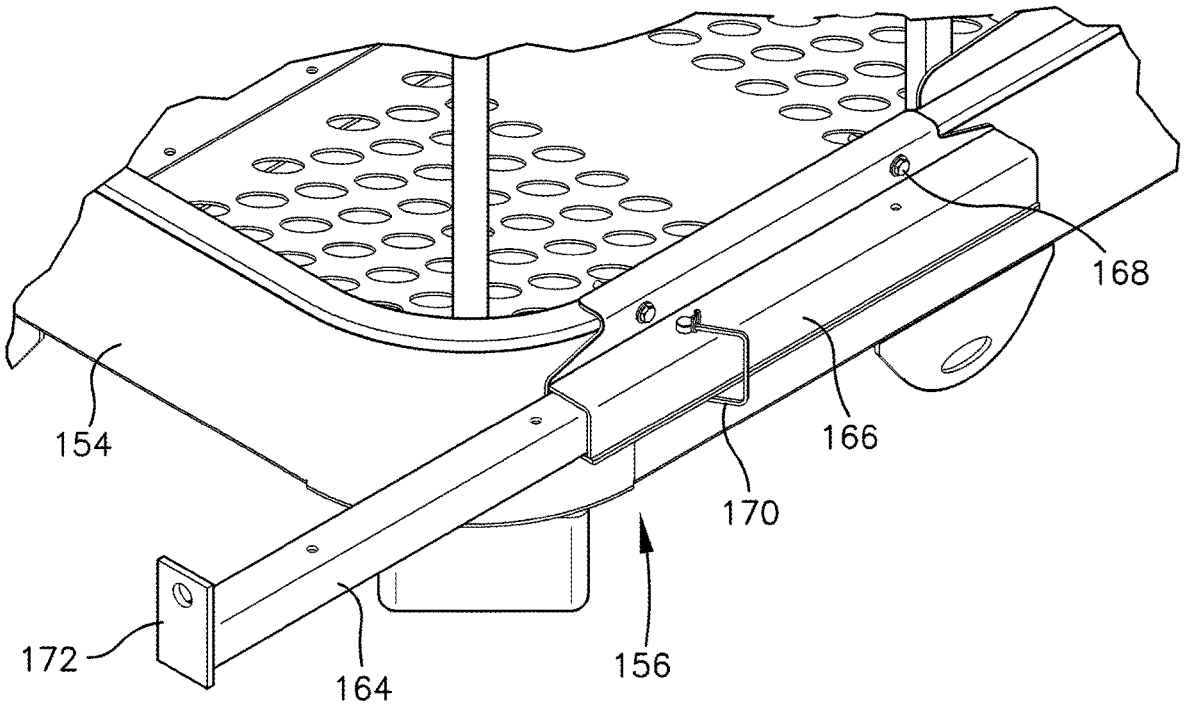
Figure 9:
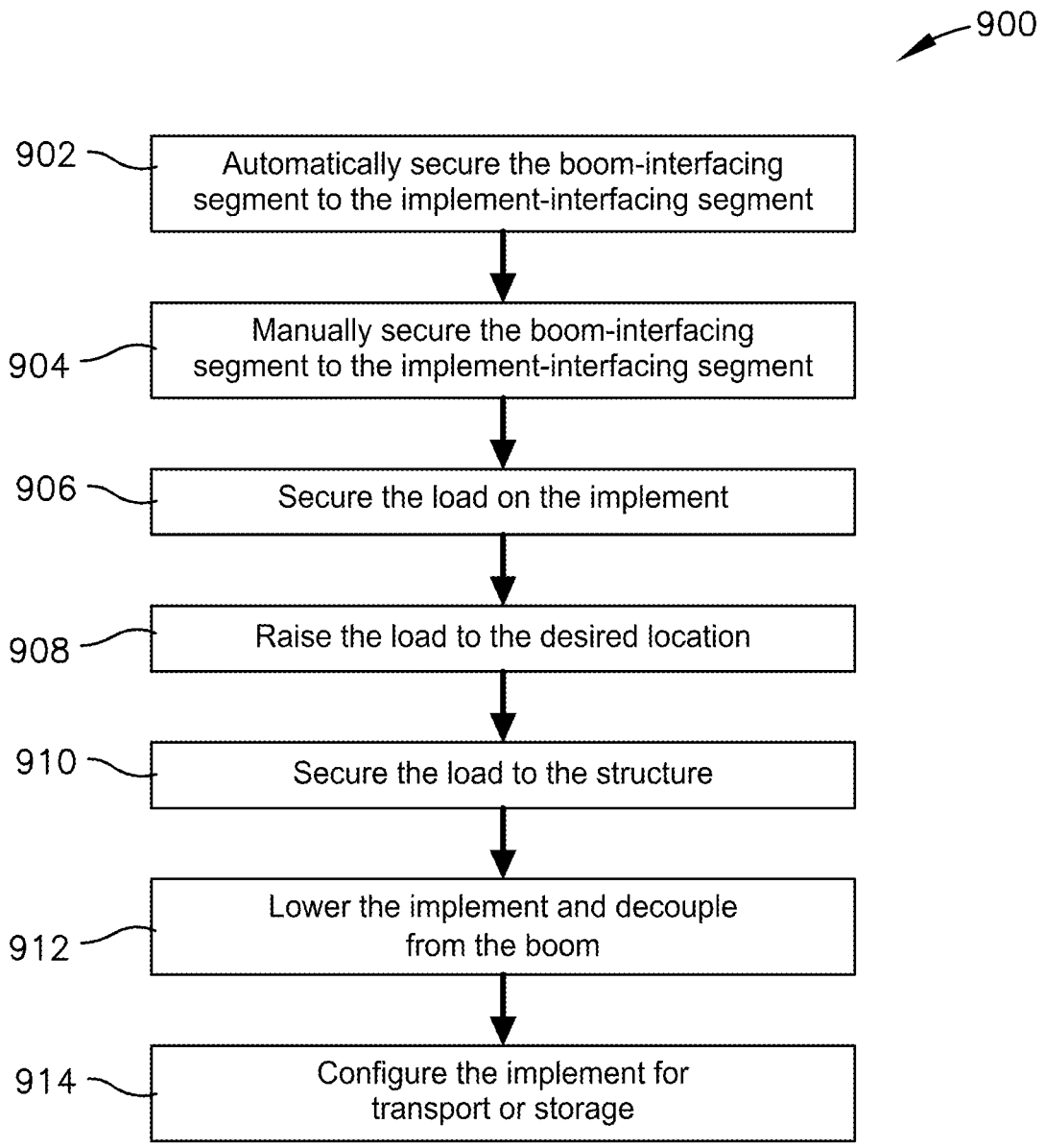

FIGS. 6A-B are perspective views of an adapter;

FIGS. 7A-B are perspective views of an aerial platform with a material handler attached;

FIGS. 8A-8B are perspective views of another embodiment of an aerial platform with a telescoping material handler attached; and FIG. 9 is an exemplary method for raising an aerial object with a material handler.

The drawing figures do not limit the invention to the specific embodiments disclosed and described herein. The drawings are not necessarily to scale, emphasis instead being placed upon clearly illustrating the principles of the invention.

DETAILED DESCRIPTION

In some embodiments, the system provides for a utility vehicle to supply a lifting device for raising objects, or loads, to aerial locations. In some embodiments, the object to be raised, referenced herein as a load, is a sign. Marketing signs, for example at gas stations, restaurants, malls, grocery stores, convenient stores, or any other establishment that uses a sign, or roadway sign, to display information may be the load. The loads may be attached to a standing structure for display to pedestrians or drivers by a walkway or roadways. As described above, it may be difficult to raise some signs that have overhanging structures or the sign may need to go underneath other signs. In the former case, the overhanging structure may not be removable and in the latter case the other signs may need to be removed from the structure or dismantled to lower the sign for placement from above. A crane or any aerial device that attaches to the sign from above may not be used in this situation. The aerial device provided in embodiments described herein provide a system for raising the sign from below thus allowing the sign to be attached to the structure without having to disconnect signs from above or alter overhanging structures. This provides efficiency and a new method for placing an aerial object on a structure.

Though some embodiments described herein are directed to a utility vehicle with a boom extension raising an implement such as a material handler, any vehicle and implement may be used. In some embodiments, the utility vehicle may be a crane or any standard truck or boom truck. The implement may be a material handler, an aerial platform, or any other attachable device.

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Figure 1:
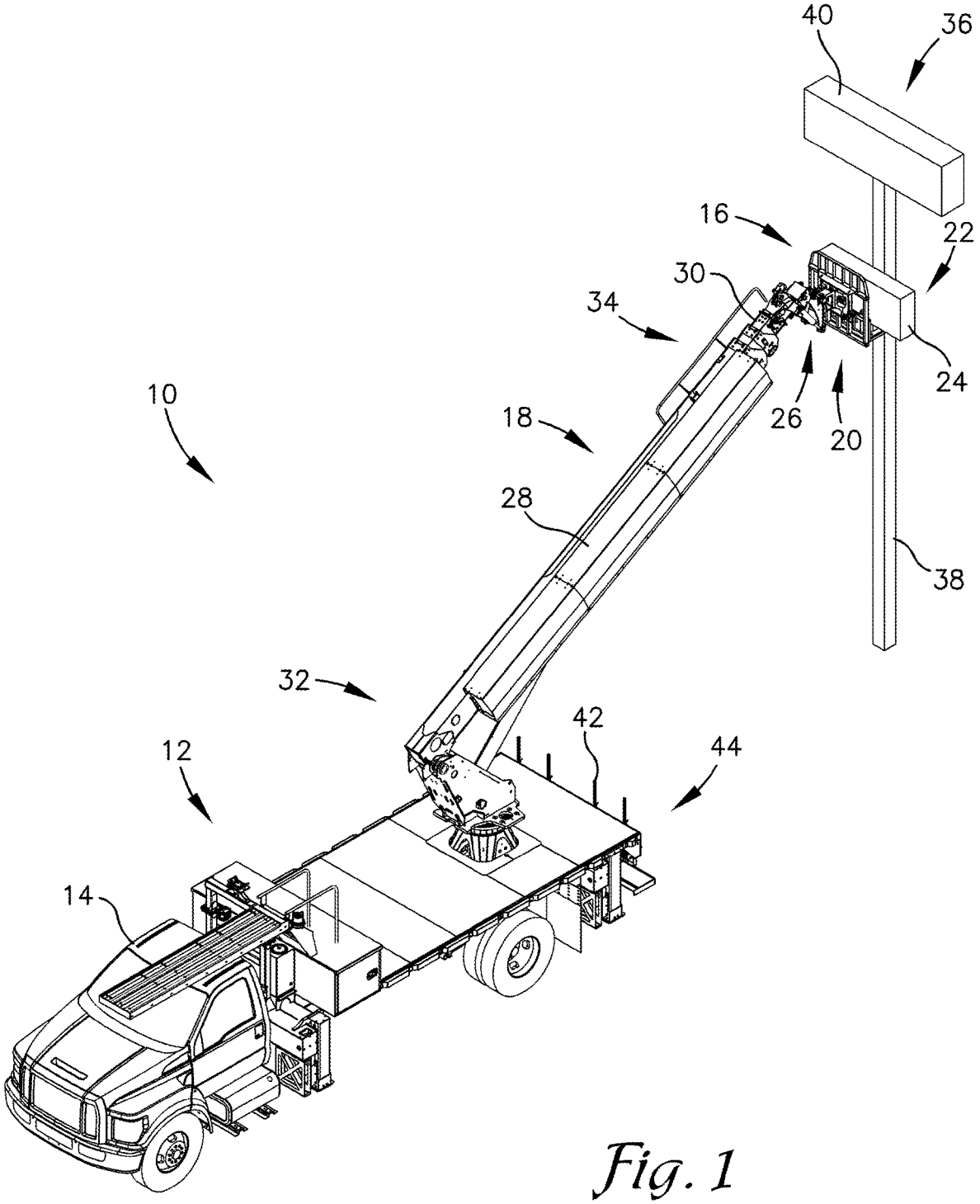
FIG. 1 is an environmental view of an aerial device with a materiel handler lifting a sign.

An embodiment of the invention depicted in FIG. 1 presents an aerial device 10 comprising a base 12. As depicted, the aerial device 10 further comprises a utility vehicle 14 with an implement 16 attached to a boom assembly 18. In the embodiment presented, the implement 16 is a material handler 20 for raising a load 22, in this embodiment a sign 24. The implement 16, such as the material handler 20, or other implement 16 for performing work, is disposed on the boom assembly 18 to facilitate the accomplishment of a task by a worker. In some embodiments, the general term implement 16 is a utility platform for workers to stand in or the implement 16 may be the material handler 20, a digger derrick, a jib, a winch, or any other implement 16 that may be useful and quickly attached that provides a working benefit. The material handler 20, is secured to the boom assembly 18 via an adapter 26, as discussed below. The adapter 26 provides for quick and easy coupling of the material handler 20 to the boom assembly 18.

The base 12 of the aerial device 10 is a selectively stabilized platform. In embodiments of the invention, the base 12 is a utility vehicle 14 (as illustrated in FIG. 1), a crane base, an oil rig, an earth-working machine, or a fixed structure. The base 12 provides stability and a counterweight to the load 22 being supported by the boom assembly 18. Larger loads typically require a more stable and a heavier base. To achieve this stability, in embodiments of the invention, the base 12 may utilize hydraulic stabilizers, outriggers, and/or sand bags.

The boom assembly 18 broadly comprises an outer boom section 28 and, in some embodiments, inner boom section 30. The boom assembly 18 presents a proximal end 32 and a distal end 34. The proximal end 32 is rotatably and/or pivotably secured to a portion of the base 12. The distal end 34 is secured to the implement 16. The optional inner boom section 30 may be in part disposed within the outer boom section 28. The inner boom section 30 may telescope to extend or retract into the outer boom section 28. As shown in FIG. 1 the inner boom section 30 is retracted into the outer boom section 28. In some embodiments there is no inner boom section 30 and only an outer boom section 28.

In embodiments of the invention, the boom assembly 18 may comprise additional equipment including any of the following: power lines for the routing of hydraulic, pneumatic, or electrical power; communication wires for user-controls located on the boom assembly 18; or support cables (not illustrated). In some embodiments of the invention, the boom assembly 18 comprises a first boom section that rotatably secures to the base 12 and a second boom section that rotatably secures to a distal end of the first boom section (not illustrated). In still other embodiments of the boom assembly 18, a combination of the telescoping and pivoting boom sections is utilized.

The inner boom section 30 may telescope into a plurality of positions with respect to the outer boom section 28, including a fully retracted position as shown, in which the length of the body of the inner boom section 30 is substantially inserted within the outer boom section 28, and a fully extended position, in which only a relatively small portion of the length of the body of the inner boom section 30 is inserted within the outer boom section 28. Further, there may be a plurality of inner boom sections 30 that may telescopically extend in and out of each subsequent inner boom section 30.

In some embodiments, the implement 16 is attached to the end of the boom assembly 18. The implement 16 may be any of the possible implements as described above. As depicted in FIG. 1 the implement 16 is a material handler 20. As depicted the material handler 20 is lifting a load 22 to be placed on an aerial support structure 36. The aerial support structure 36, in this exemplary embodiment, is a sign post 38, and the aerial load 22 is the sign 24.

In some embodiments, the aerial device 10 is used to raise the load 22 to be placed on the aerial support structure 36. As depicted in FIG. 1, the sign 24 is raised to a location on the sign post 38 by material handler 20. A header 40 is atop the sign post 38 such that it may be impossible or extremely difficult to raise the sign 24 with a crane connected to the sign 24 from above. The header 40 is in a position that would block the sign 24 from being placed into position for attachment to the sign post 38. Since the material handler 20 raises the sign 24 from below, the sign 24 may be placed in the desired location on the sign post 38 more efficiently. For example, if the sign 24 is raised to the location by a crane attached from above, the crane cables would contact the header 40 and the sign 24 would not be in the correct position for attachment to the sign post 38. The header 40 would have to the removed and the sign 24 would be placed on the sign post 38 at the desired position, then the header 40 placed back on top of the sign post 38. If the sign 24 is to be attached to the header 40, then the header 40 must still be removed and laid on the ground for the sign 24 to be attached. If the header 40 is not removable, the entire sign post 38 along with the header 40 would be laid down and the sign 24 would be attached on the ground. These methods are inefficient and would result in many man hours required to attach the sign 24. Raising the sign 24 with the material handler 20 from below, decreases the man hours and the equipment fees associated with attaching the sign 24 to the sign post 38.

In some embodiments, the implement 16 may be removable and may be stored on the utility vehicle 14. The implement 16 may be placed on the utility vehicle 14 on a storage rack 42 on a back portion 44 of the utility vehicle. For example, the material handler 20 may be stored on any portion of the utility vehicle 14 for transport or while other implements 16 are mounted on the boom assembly 18. In some embodiments, the material handler 20 may fold into a storage configuration such that the material handler 20 is small and easily storable. The storage configuration may be folded such that any platform or forks fold up to decrease the area needed to store the material handler 20. The material handler 20 configurations are discussed in more detail below.

Figure 2:
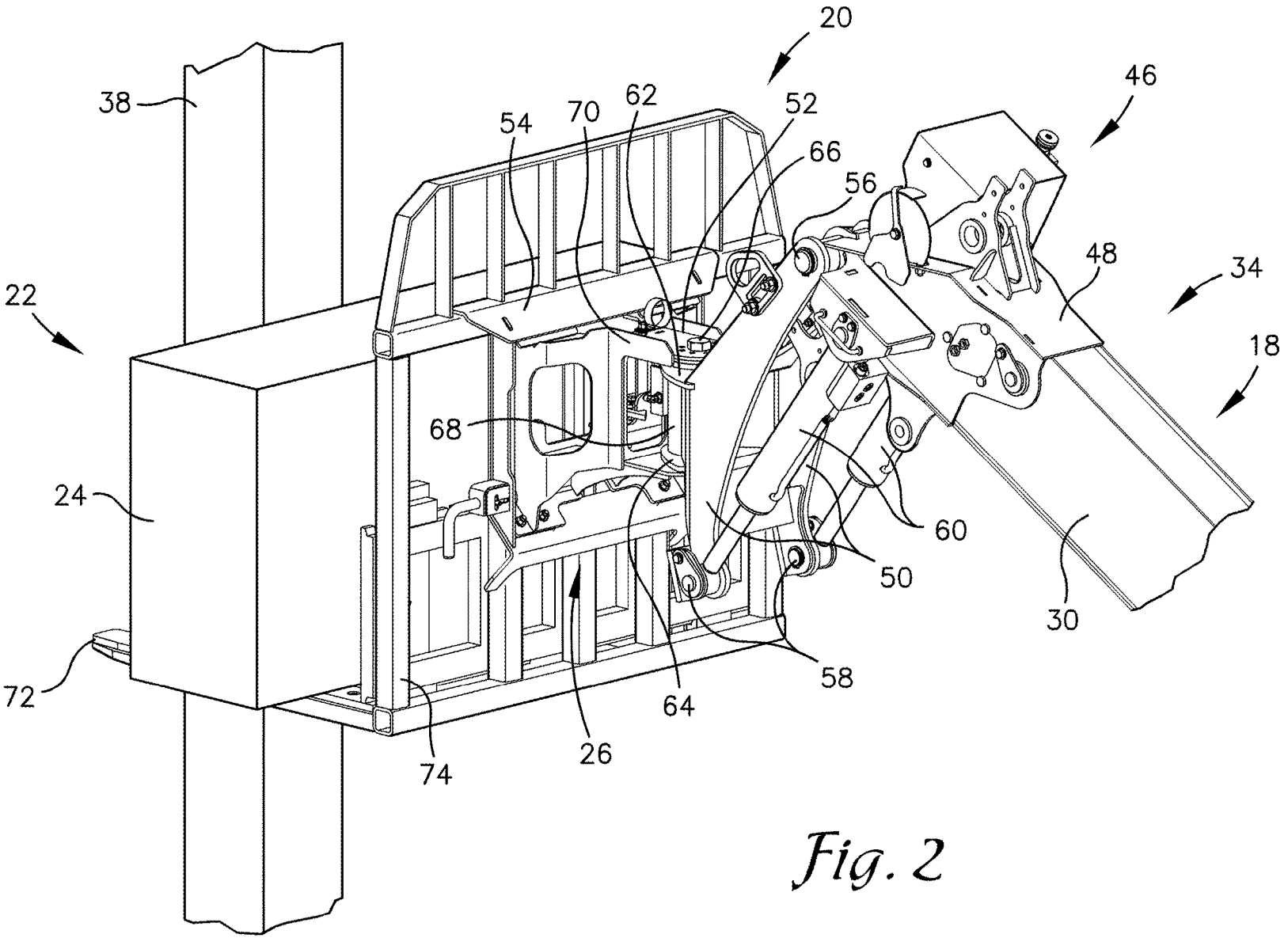
FIG. 2 is a close-up view of an embodiment of the boom assembly and material handler attachment of FIG. 1.

FIG. 2 depicts a closeup of an embodiment of the material handler 20 supporting the sign 24 into place on the sign post 38. A boom raise 46 is disposed at the distal end 34 of the boom assembly 18 and attached to the inner boom 30. The boom raise 46 may be a segment or portion of the inner boom section 30 as attached and adapted to receive and securely hold the implement 16. Some embodiments of the boom raise 46 also pivot or rotate as to assist the performance of the work. For example, the boom raise 46 may pivot to maintain a digger derrick vertical during the drilling of a hole in the ground. As another example, the boom raise 46 may pivot to ensure that the material handler 20 remains level with the ground. The movement of the boom raise 46 may be automatic, controlled by the utility worker, or both.

The boom raise 46 may comprise a boom-attachment section 48 and support arms 50 that attach the boom raise 46 to the adapter 26 comprising a boom-interfacing segment 52 and an implement-interfacing segment 54 which will be discussed in greater detail below. The support arms 50 may be attached to the boom-attachment section 48 by upper support arm pins 56 and lower support arm pins 58. The implement 16 may be raised and lowered by pivoting about the upper support arm pins 56 by extending and retracting the pistons 60. This allows the implement 16 to rotate into a raised and lowered position. In the case that the implement 16 is the material handler 20, the load 22 to be raised may be further supported against a backrest of the material handler 20 when the material handler 20 is in a tilted position. Tilting the material handler 20 may raise a distal end of forks 72 such that the load 22 rests against the carriage 74 providing more support for the load 22 when moving the implement 16.

The support arms 50 may be attached to the adaptor 26 at the boom-interfacing segment 52 at the support arm upper plate 62 and support arm lower plate 64. The support arm upper plate 62 and support arm lower plate 64 may be attached to the boom-interfacing segment 52 using a vertical support pin 66. Vertical support pin 66 may be a pin that allows the adapter 26 to rotate about a vertical axis by a piston (not shown) attached to the adapter 26. In some embodiments, a rotating drum 68 is a motor that provides rotation to the adapter 26 about the vertical support pin 66 and is disposed between the support arm upper plate 62 and support arm lower plate 64. Further, the support arm upper plate 62 and the support arm lower plate 64 may be attached to the boom-interfacing segment 52 of the adapter 26 by way of a boom attachment segment 70 of the boom-interfacing segment 52. These configurations provide for rotation about a substantially vertical axis allowing the implement 16 and load 22 to be rotated providing another degree of freedom for movement. This allows the load 22 to be easily moved into a desired position to place, and attach, the load 22 to the sign post 38 under the header 40.

The pistons 60 and the rotating drum 68 may use hydraulics and/or pneumatics for operation. Though hydraulics are used in embodiments described herein, it should be noted that electric motors, fuel powered motors, or any of the such could be used in embodiments of the invention. The motors may be attached at the base 12 or may be powered by any power source at the base 12 and lines may carry air, hydraulic fluid, or electricity from the base 12 to the motors. In some embodiments, the motors and the power sources for the motors are attached at the distal end 34 of the boom assembly 18 or on any component attached thereto. This may allow separation of the motors from the base 12 below.

Figure 3:
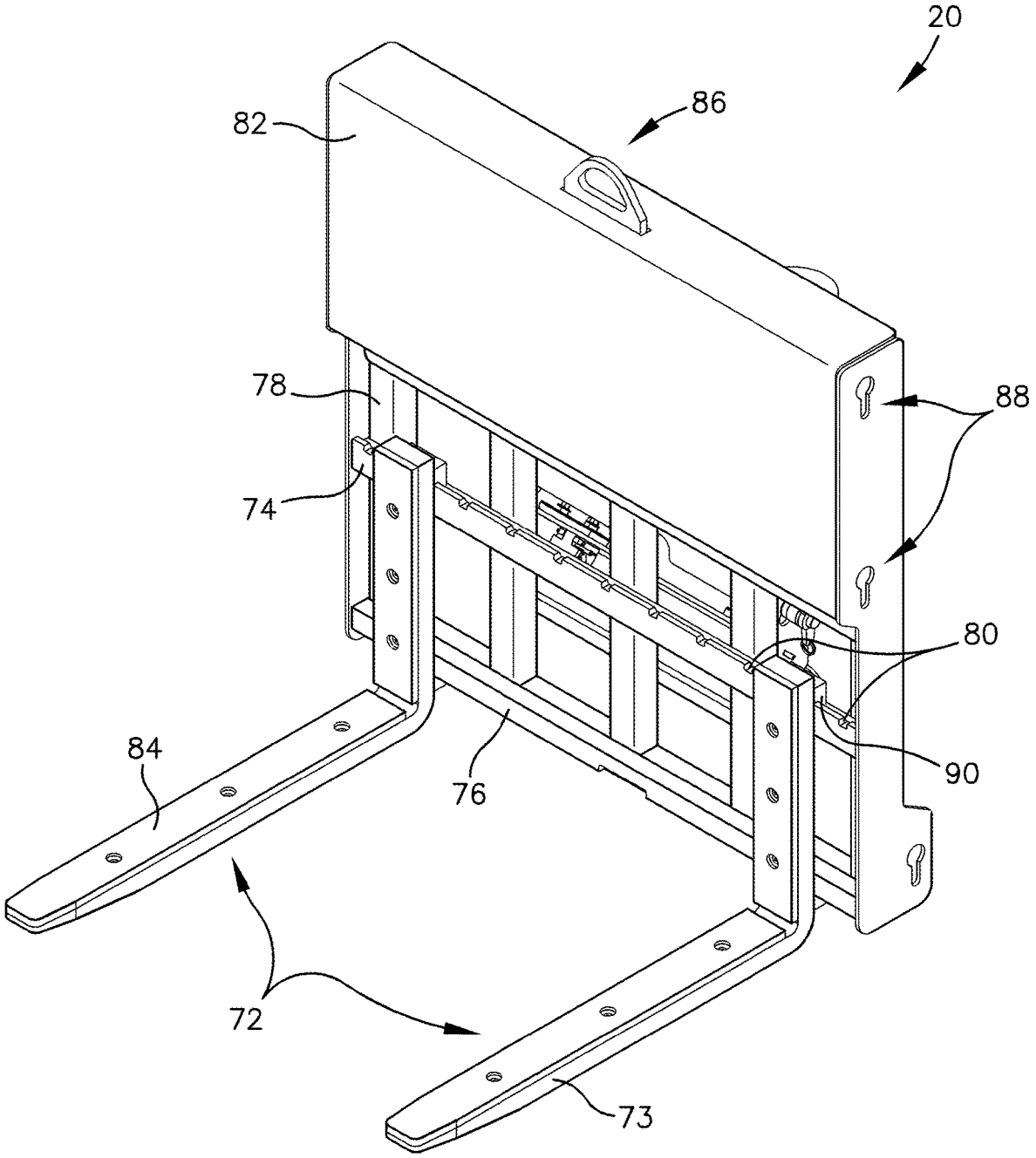
FIG. 3 is a perspective view of an embodiment of the front of a material handler.

FIG. 3 depicts an embodiment of the material handler 20 with an open carriage 74. The carriage 74 may comprise horizontal members 76 and vertical members 78 for providing support to the forks 72. The material handler 20 supports the load 22 which in some embodiments may be the sign 24, from below using the forks 72, The material handler 20 forks 72 are adjustable and separated wide enough to both support the load 22 and the forks 72 may pass on each side of the single support structure 36. The forks 72 enable the material handler 20 to access a diverse population of aerial support structures 36. In some embodiments, the forks 72 may be one fork and may be widened representing a platform shape. In some embodiments, the platform may be a fork or a plurality of forks, as shown as forks 72 in FIG. 3.

The carriage may comprise multiple notches 80 that allow the forks 72 to lock into place. The forks 72 may comprise protrusions on the back for locking into the notches 80. This allows the forks 72 to be adjustable and may be locked into place at any position along the carriage 74.

The forks 72 being adjustable along the carriage 74, passing on each side of the support structure 36, as depicted in FIGS. 1-3 may allow for multiple loads 22 to be lifted simultaneously and may provide access to many styles of support structures 36. Since the forks 72 may pass on each side of the support structure 36, a second load (not shown) may be supported on the far side of the support structure 36. This allows the material handler 20 to lift multiple loads rather than only one load 22 which would not be allowable using a crane-style lift. Further, since a crane-style lift would raise the loads 22 from above, the header 40 would have to be removed in order to attach the load 22 as described above. The material handler 20 thus reduces man hours and increases efficiency over standard crane-style lifting devices in the field.

Continuing with the embodiment depicted in FIG. 3 presenting a front of the material handler 20 comprising the carriage 74, a backrest 82, the forks 72, support pads 84, and a hoop 86. The carriage 74 may provide structure for the material handler 20. The carriage 74 may be configured to support both the implement-interfacing segment 54 and the load 22 that may be supported on the forks 72. The carriage 74 and the horizontal members 76 and the vertical members 78 may be made of rods, tubes, pipes, and may be configured in a truss style structure. In some embodiments the carriage 74 may be made of metal such as steel or aluminum or any alloy, or the carriage 74 may be made of a composite such as carbon fiber or fiberglass or any combination thereof. The carriage 74 as well as any portion of the material handler 20 may be made of any material light enough and strong enough to complete the tasks as described herein.

In some embodiments, the material handler 20 comprises the backrest 82. The backrest 82 may provide extra support for leaning the load 22 against the backrest 82 or back support and attaching the load 22 to the material handler 20. The backrest 82, as depicted in FIG. 3, provides surface area for the load 22 and solid structure along the back where the load 22 may be supported. The backrest 82 also provides openings 88 for attachment of other implement devices or for securing the load 22. The openings 88 may be used to attach pins for supporting u-bolt like attachments or may be used for attaching pull-downs, tie-downs, chains, bolts, pins, rods, or any other type of attachment for securing the load 22. The backrest 82 may be attached to the carriage 74 by welding or any of the attachment methods described above.

In some embodiments, the backrest 82 comprises the hoop 86. The hoop 86 may be used to attach the material handler 20 to a crane or other object for transport. The hoop 86 may also be used to secure the material handler 20 to the back of the utility vehicle 14 as described above. In some embodiments, the hoop 86 may be used to secure the load 22 with cables, tie-downs, or any of the above mentioned methods. The hoop 86 may be on the top of the backrest 82 as depicted in FIG. 3, on the sides, on the bottom, and there may be a plurality of hoops located at any position on the backrest 82 or the carriage 74. The hoop 86 may be located on the backrest 82, carriage 74, forks 72, or at any location on the material handler 20 for attaching other devices to the material handler 20 or for securing the load 22 to the material handler 20.

In some embodiments, the material handler 20 is configured with forks 72 for supporting the load 22. The forks 72 may support the load 22 from below or may slide into the load 22 or a base supporting the load 22 such as a pallet. The forks 72 may be adjustable side to side by sliding the forks 72 along a rung or horizontal member 76 of the carriage 74. The horizontal members 76 could be round bars, square, or any shape sufficient to support the forks 72. The rung may be configured with notches 80 for holding the forks 72 in a desired location consistent with supporting the load 22 as described above. The forks 72 may further be secured to the carriage 74 or backrest 82 with bolts, screws, plastic or rubber ties, or any other method that may secure the forks 72 to the carriage 74 or backrest 82.

The forks 72 may also comprise hooks 90 that rest on top of the carriage 74 and support the forks 72 from behind. The hooks 90 may support the forks 72 from both above the rung and a set of hooks (not shown) may support from below a lower rung. The hooks 90 may be adjustable and lock into place with a pin, bolts, clamps, or any other method described herein. Further, the hooks 90 may be configured with protrusions for sliding into the notches 80 securing the forks 72 in a desired location.

In some embodiments, the forks 72 may be configured with support pads 84 for supporting the load 22. The support pads 84 may be made of wood, rubber, plastic, metal, or a composite material for weight savings, strength, and to provide a material between the forks 72 and the load 22 such that the load 22 and forks 72 are not damaged. In some embodiments, the support pads 84, forks 72, or any other part of the material handler 20 may be made of an ultra-high molecular weight polyethylene. This may provide weight savings while further providing the strength required to lift designated load weights.

In some embodiments, the forks 72 are a single fork 73 or a platform presenting a flat wide shape for supporting the load 22. The platform may be rectangular, square, oval, or triangular shaped, or any other shape that may be useful for supporting different shaped loads 22. The single flattened fork 73 or platform may be made of or have support pads 84 secured to the upper surface for supporting the load 22. As with the multiple forks 72, the support pads 84 may be secured with adhesive, or fasteners such as bolts, screws, rivets, pins, or any other attachment method.

Figure 4:
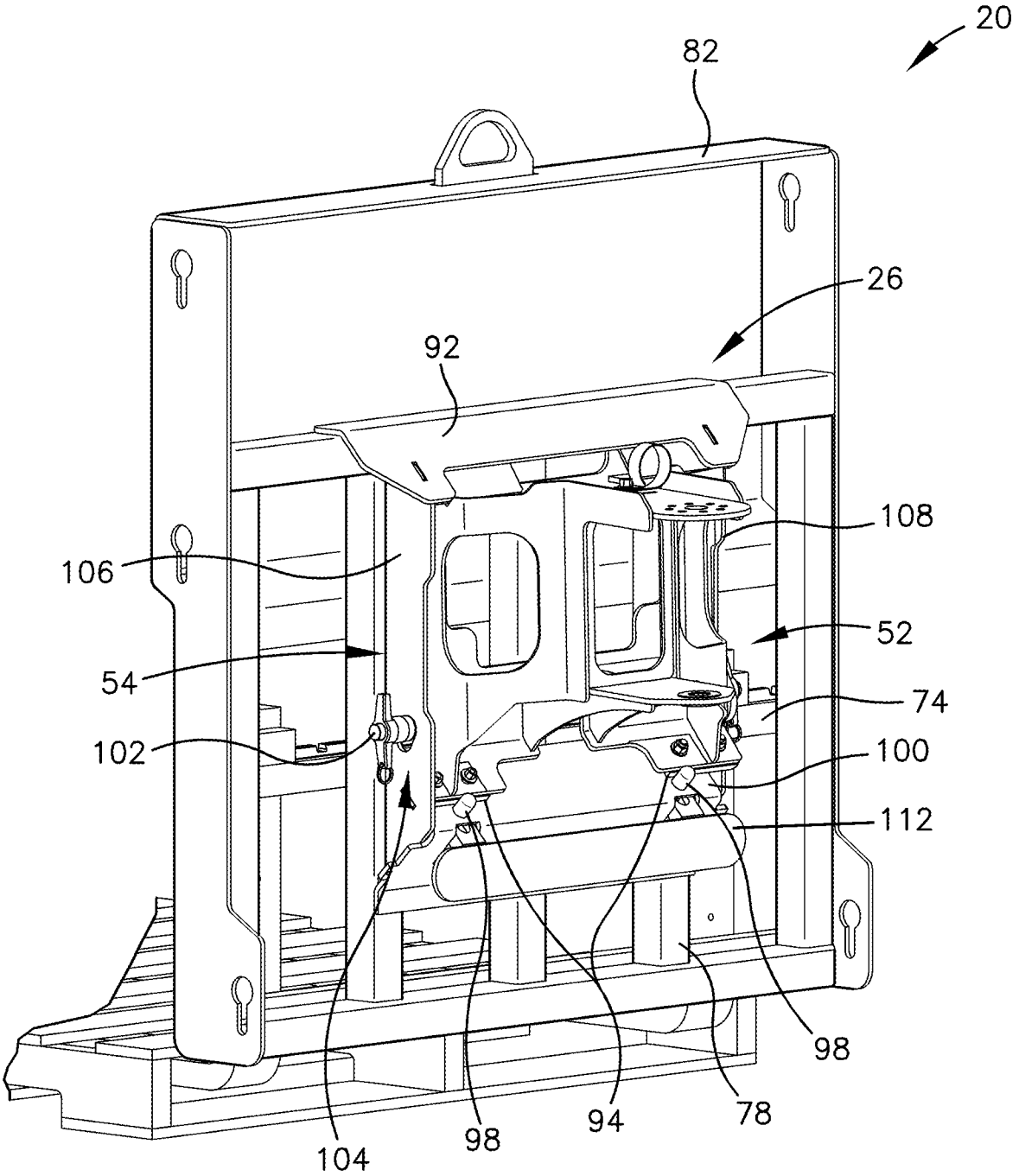
FIG. 4 is a perspective view of an embodiment of the back of the material handler of FIG. 3.

Turning to an embodiment depicted in FIG. 4, presenting a back view of the material handler 20 with the backrest 82 and the carriage 74 configured to support the adapter 26 comprising the implement-interfacing segment 54 and the boom-interfacing segment 52. The implement-interfacing segment 54 may be attached to the material handler 20 at the carriage 74 as shown. The implement-interfacing segment 54 may be attached to the material handler 20 by weld or fasteners such as bolts, screws, pins, locking mechanisms or any combination of the fasteners as described above. The implement-interfacing segment 54 may be attached to any of the horizontal members 76 and the vertical members 78. This allows the implement-interfacing segment 54 to be placed at different locations relative to the boom assembly 18 allowing access to different locations.

The implement-interfacing segment 54 may comprise a vertically oriented upper wedge plate 92 resulting in a wedge-shaped recess below the wedge protrusion for receiving the boom-interfacing segment 52. The upper wedge plate 92 may receive the boom-interfacing segment 52 wedge as best depicted in FIGS. 6A & 6B.

In some embodiments, a similar quick-attachment system and method is used. The similar quick-attachment system and method is described in the previously filed Non-Provisional application Ser. No. 14/564,381, filed Dec. 9, 2014, and entitled "AERIAL DEVICE WITH QUICK-COUPLING IMPLEMENT" and incorporated by reference in its entirety herein.

Continuing with the embodiments depicted in FIG. 4 presenting the material handler 20, the implement-interfacing segment 54, and the boom-interfacing segment 52, the boom-interfacing segment 52 may be configured to slide into the implement-interfacing segment from slightly below. Lower pads 94 of the boom-interfacing segment contact and depress springs 96, as best seen in FIG. 5B, loaded securing pins 98. As the securing pins 98 depress, compressing springs 96 into the base plate 100, the boom-interfacing segment 52 slides upward under the upper wedge plate 92. Once the boom-interfacing segment 52 is fully inserted into the implement-interfacing segment 54 as shown, the securing pins 98 release and pop out due to the springs 96 forcing the securing pins 98 outward securing the boom-interfacing implement 52 into position as shown.

Further securing the boom-interfacing segment 52 into the implement-interfacing segment 54 are the retaining pins 102. The retaining pins 102 are placed through the opening 104 in the left side 106 and the right side 108 of the implement-interfacing segment 54 and through openings 110, as best seen in FIGS. 6A and 6B, in the boom-interfacing segment 52 thus further securing the boom-interfacing segment 52 to the implement-interfacing segment 54. The retaining pins 102 may be secured such that they do not vibrate or slide loose and secure the boom-interfacing segment 52 to the implement-interfacing segment 54.

In some embodiments, a release bar 112 is provided below the base plate 100 to provide a quick-release mechanism. The release bar 112, when depressed, compressing springs 96 from behind the base plate 100. When the release bar 112 is depressed and the springs 96 depress, the securing pins 98 may retract into the base plate 100 allowing the boom-interfacing segment 52 to be removed from the implement-interfacing segment 54.

Figure 5A:
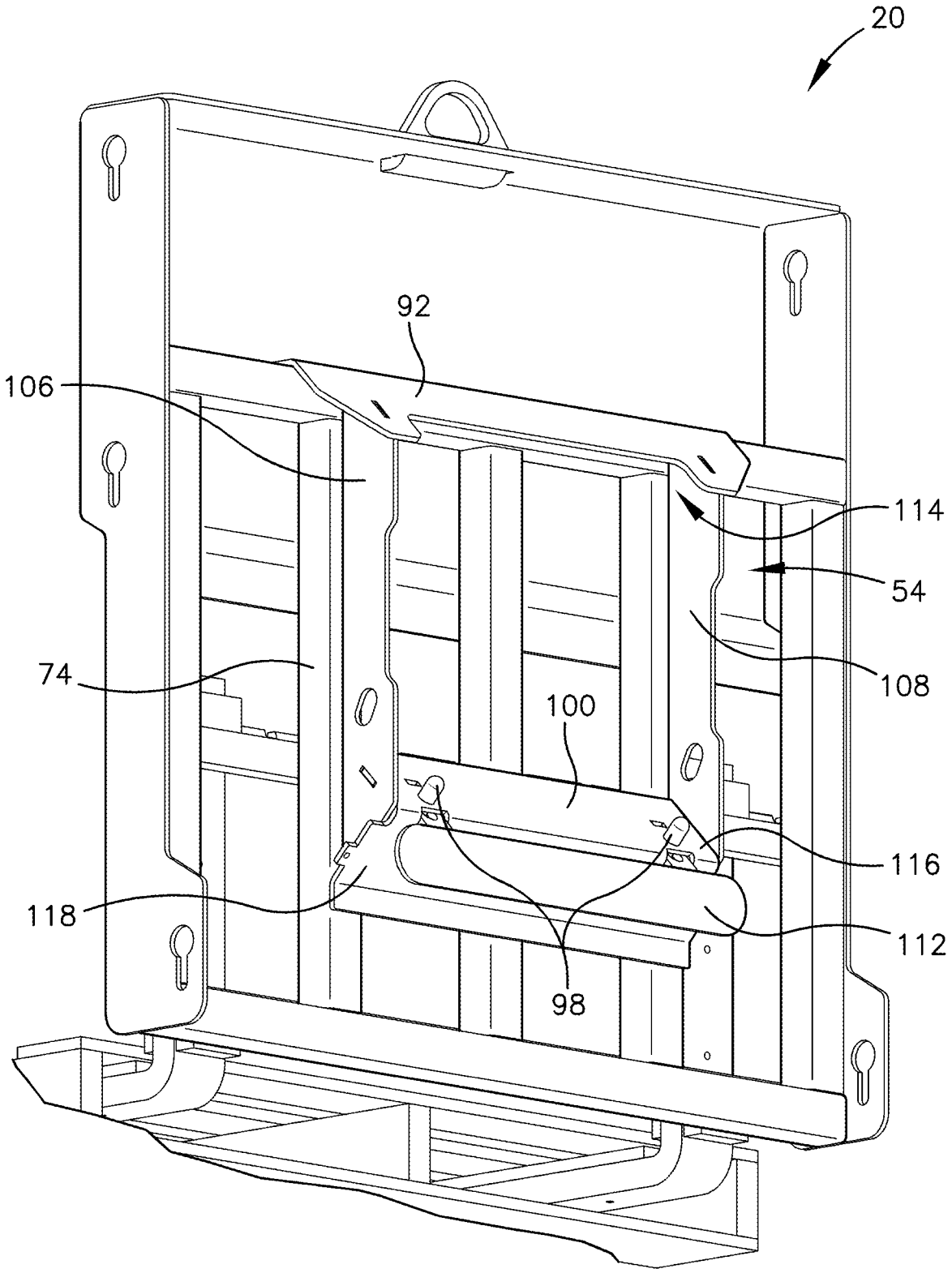
FIG. 5A is a perspective view of an embodiment of an implement-interfacing segment.
Figure 5B:
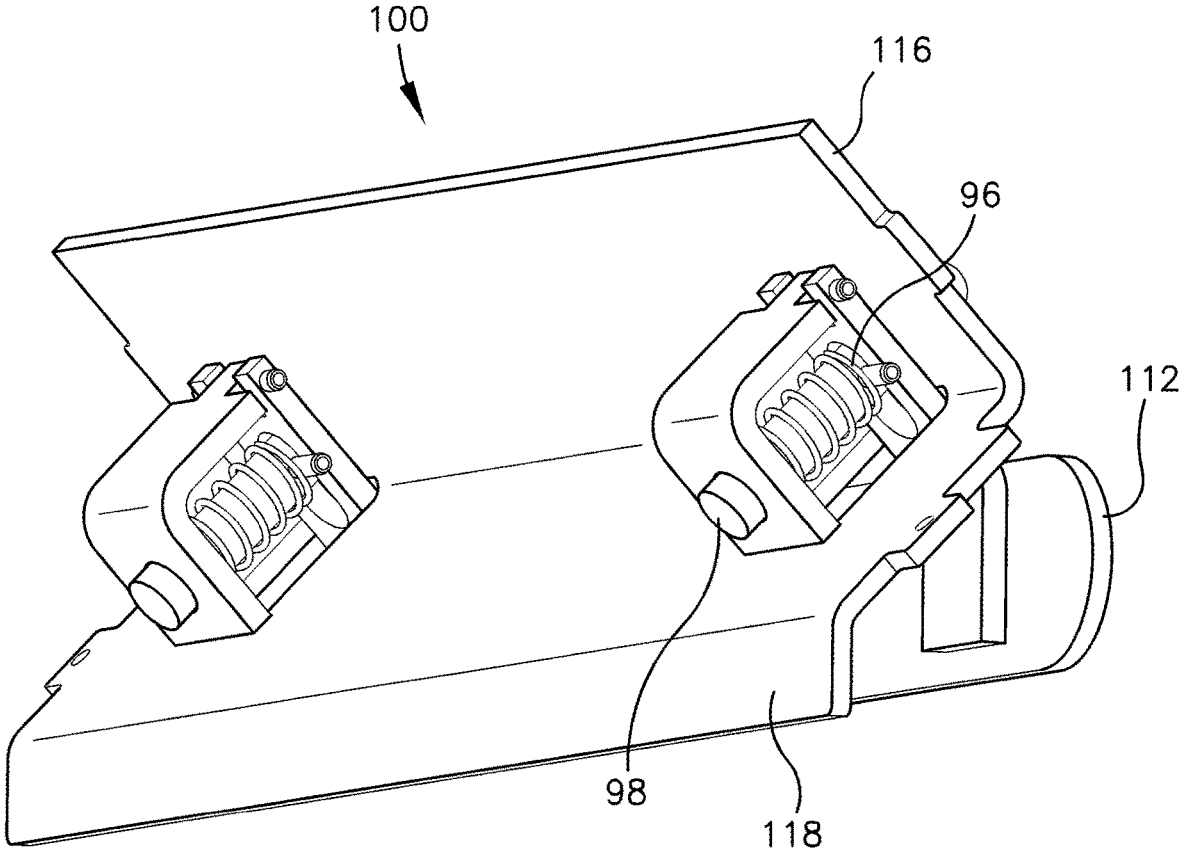
FIG. 5B is a perspective view of an embodiment of a bumper and spring mechanism of the boom-interfacing segment of FIG. 5A.

Turning now to FIG. 5A depicting an embodiment of the back of the material handler 20 comprising the implement-interfacing segment 54. As depicted, the implement-interfacing segment 54 is detached from the boom-interfacing segment 52. The implement-interfacing segment 54 comprises the upper wedge plate 92 presented at an angle creating the wedge-shaped recess 114 below. The wedge-shaped recess 114 for receiving the boom-interface segment 52 is covered on each side by left side plate 106 and right side plate 108. The left side plate 106 and right side plate 108 extend from the upper wedge plate 92 to the base plate 100. The base plate 100 comprises a base plate upper face 116 and a base plate lower face 118. The base plate upper face 116 is for receiving a lower portion of the boom-interfacing segment 52 and guiding the boom-interfacing segment 52 upward such that an upper portion of the boom-interfacing segment 52 slides into the wedge-shaped recess 114. The implement-interfacing segment 54 may be attached to the carriage 74 at the upper wedge plate 92, the left side plate 106, the right side plate 108, or at any portion of the base plate 100. The attachment may be a weld, bolts, or any of the attachment methods described above.

Further, the base plate 100 may comprise the release bar 112 and securing pin 98 mechanism for receiving and securing the boom-interfacing segment 52. As depicted in FIG. 5B presenting an under side of the base plate 100, the securing springs 98 are depicted as attached to the securing pins 98 and the release bar 112. As the securing pins 98 are pressed by pressing the release bar 112, the springs 96 are compressed allowing the securing pins 98 to depress below the surface of the base plate upper face 116 and allow the boom-interfacing segment 52 to slide downward and release from the implement-interfacing segment 54.

Turning now to FIG. 6A depicting a front of the boom-interfacing segment 52 for interacting with the implement-interfacing segment 54. The boom-interacting segment 52 providing a front face with a front pad 120 for softening the contact between the boom-interfacing segment 52 and the implement-interfacing segment 54. The front pad 120 may be attached with adhesive, bolts, screws or any other attachment described above. There may be one or a plurality of front pads 120 depending on the contact, interaction, and need for the number of front pads 120.

In some embodiments, the boom-interfacing segment 52 may be configured with an angled bottom plate 122. The angled bottom plate 122 may be for contacting the implement-interfacing segment 54 base plate upper face 116. The angle of the angled bottom plate 122 contacting the implement-interfacing segment 54 base plate upper face 116 forces the boom-segment upward such that the upper portion of the boom-interfacing segment 52 comprising an upper wedge-shaped section 124 slides into the wedge-shaped recess 114 of the implement-interfacing segment 54. The angled bottom plate 122 may be configured with lower pads 94 to contact the implement-interfacing segment 54 such that the materials comprising the implement-interfacing segment 54 and the boom-interfacing segment 52 do not directly contact. This may provide resistance to damage and a soft cushion between the parts.

Turning now to an embodiment of the boom-interfacing segment depicted in FIG. 6B presenting a back of the boom-interfacing segment 52 comprising left and right sides 130 conforming into back plate 132, the wedge-shaped section 124 comprising an upper angled plate 134, an upper mount 136, and a lower mount 138, for attaching the boom raise 46 to the boom-interfacing segment 52. As described above, the lower portion of the boom-interfacing segment 52 provides the bottom angled plate 122 for forcing the boom-interfacing segment 52 upward where the upper angled plate 134 slides into the wedge-shaped recess 114 of the implement-interfacing segment 54. The wedge-shaped recess 114 receives the upper angled plate 134 and the boom-interfacing segment 52 may then support the weight of the implement-interfacing segment 54 and the load 22 supported by the implement-interfacing segment 54 by the upper angled plate 134 in the wedge-shaped recess 114. The implement-interfacing segment 54 is further secured with the securing pins 98 and the retaining pins 102 provided through openings 104 on the implement-interfacing segment 54 and through openings 110 on the boom-interfacing segment 52.

The boom-interfacing segment is further configured with the upper mount 136 and the lower mount 138 for mounting the rotating motor 68, or vertical pin 66, there through. A hydraulic motor (not depicted) may be attached to the boom assembly 18 and provide rotation about a vertical axis there through as described above.

In some embodiments, the material handler 20, or any other implement 16, is provided on a utility platform assembly 140 as depicted in FIGS. 7A-B. The aerial device 10 utilizes the implement 16 to perform tasks that could include, but are not limited to: raising and lowering one or more utility workers located inside the utility platform assembly 140; lifting a pallet of wood with a load on the material handler 20; or raising a load 22 such as a sign 24 described above. The implement 16 could therefore be any attachment for accomplishing a task from the distal end 34 of the boom assembly 18, or any combination of attachments. It should be appreciated that while the implement 16 depicted in FIGS. 1-6B is the material handler 20, embodiments of the invention comprise other types of implements 16, such as those discussed herein or equivalents.

In some embodiments of the invention, the implement 16 is a utility platform assembly 140, as illustrated in FIGS. 7A-B. The utility platform assembly 140 comprises a utility platform 142 and controls 144, and may additionally comprise the material handler 20 and the implement-interfacing segment 54 for attaching to the boom-interfacing segment 52 attached to the boom raise 46 connected to the inner boom 30. The utility platform 140 provides an elevated surface from which at least one utility worker can perform a task. The controls 144 interface between utility platform 140 and the boom assembly 18 and/or the utility vehicle 14. As such, the utility platform may be quickly coupled to the boom assembly 18 by the adaptor 26.

In embodiments of the invention as best illustrated in FIGS. 7A-B, the utility platform 140 comprises four bucket sidewalls 148 and a bucket floor 150 that collectively form a cavity. The utility worker stands in the cavity to perform work. The utility platform 140 may further comprise a door 152 in at least one of the bucket sidewalls 148 to allow for ingress and egress of the utility worker. The utility platform 140 may also comprise a handrail (not shown) for utility worker safety.

In embodiments of the invention, the utility platform 140 remains substantially level regardless of the position of the boom assembly 18. In other embodiments, the utility worker manipulates the controls 144 to manipulate the utility platform 140 into the flat position. The control of the platform may be accomplished by extending and retracting the pistons 60 and the rotating drum 68 as described above.

In some embodiments, the utility platform 140 is coupled to the boom assembly 18 using the adapter 26 described above. The implement-interfacing segment 54 may be attached to the utility platform 140 and the implement-interfacing segment 54 is attached to the boom-interfacing segment 52 allowing the boom assembly 18 to control the movement of the utility platform 140. Further, the utility platform controls 144 may control the boom assembly 18 and any power on the utility platform 140 using wired transmission such as plug-and-play or any wireless transmission.

In some embodiments, the material handler 20 may be included with the utility platform 140. The utility platform 140 side walls 148 may comprise the material handler carriage 74 or backrest 82 and the utility platform 140, or forks 72, may be coupled to a support structure of the utility platform 140. The forks 72 may be attached to a base 154 of the utility platform 140 and may be adjustable vertically as well as laterally in relation to the utility platform 140. The forks 72 may be attached permanently or may be detachable. In some embodiments, the forks 72 may be load pegs as discussed in more detail below.

The load 22 may be attached to or mounted on the forks 72 on the material handler 20 or the utility platform 140. The load 22 may be secured to the utility platform 140 or material handler 20, carriage 74 or backrest 82, or side walls 148 of the utility platform 140, or any hooks or attachments provided on the utility platform 140. The utility platform 140 may be manufactured with the material handler 20 in mind and may be manufactured to support typical loads 22 as described herein.

Turning now to FIG. 8A depicting an embodiment of the utility platform 140 where the forks 72 are load pegs 156. In some embodiments, the utility platform 140 may be secured to the boom assembly 18 or to the implement-interfacing segment 54 by a securing plate 158 and a cylinder 160 attached to the utility platform 140 by horizontal structure plates 162. The attachment is exemplary and in some embodiments the utility platform 140 may be attached to the implement-interfacing segment 54 as described above.

In some embodiments, the utility platform 140 comprises inner load pegs 164 telescopically extending in and out of outer load peg 166. The outer load peg 166 may be secured to the utility platform 140 by fasteners 168. The inner load peg 164 may be attached to the outer load peg 166 and secured in position by peg pins 170.

Turning now to a closeup view of the load peg 156 depicted in FIG. 8B where the load peg 156 is configured to be secured to the utility platform 140. As shown the outer load peg 166 is configured to secure to the utility platform 140 at the base 154. The outer load peg 166 may be attached using the fasteners 168. The fasteners 168 may be pins, rivets, screws, bolts, or any other fastener that may be strong enough to support the load 22. Though the outer load peg 166 is attached to the base 154 as depicted, the load pegs 156 may be attached at any location of the utility platform 140 and at any location of the load pegs 156.

In some embodiments, the inner load peg 164 is attached and positioned relative to the outer load pin by the peg pins 170. The peg pins 170 may be pins, rivets, screws, bolts, cotter pins, u-bolts, or any other type fastener that secures the inner load peg 164 to the outer load peg 166 as described in embodiments of the invention.

The inner load peg 164, in embodiments, may comprise end plate 172. End plate 172, may be a flat plate that secures the load 22 on the load peg 156. As depicted the end plate 172 may be small, but the end plate 172 may be any size that may aid in supporting the load 22. Further, in some embodiments, the end plate 172 may comprise a hole for attaching any rope, tie-down, or fasteners for securing the load 22 on the load peg 156. In some embodiments, the load pegs 156 may support designated weights up to and including 1,000 pounds.

Turning now to an exemplary method depicted in FIG. 9 generally represented by the numeral 900 for attaching the implement 16 to the boom assembly 18 using the adapter 26 and raising the load 22. In a Step 902, a utility worker manipulates the boom assembly 18 to align with the implement 16. The boom assembly 18, coupled to the boom-interfacing segment 52, is moved toward the implement 16, comprising the implement-interfacing segment 54. The boom-interfacing segment 52 is moved into the implement-interfacing segment 54. When a contact between the boom-interfacing segment 52 and the implement-interfacing segment 54 occurs the boom-interfacing segment 52 slides into the wedge-shaped recess 114 of the implement-interfacing segment 54. This allows the boom-interfacing segment 52 to automatically align with the implement-interfacing segment 54 such that the segments may be secured together. The implement-interfacing segment 54 and the boom-interfacing segment 52 are secured together by an automatic coupling mechanism or adapter 26. In embodiments described above, securing pins 98 with springs 96 configured on the implement-interfacing segment 54 are pressed by the boom-interfacing segment 52, The springs 96 compress allowing the boom-interfacing segment 52 to slide into place in the wedge-shaped recess 114 of the implement-interfacing segment 54. Upon placement of the boom-interfacing segment 52, the springs 96 extend, forcing the securing pins 98 to extend beyond the face of the base plate upper face 116 of the implement-interfacing segment 54 locking the boom-interfacing segment 52 in place.

In a Step 904, the implement-interfacing segment 54 and the boom-interfacing segment 52 are secured together by a manual coupling mechanism. In embodiments described above, the manual coupling mechanism is a set of retaining pins 102. The retaining pins 102 may slide through both the boom-interfacing segment openings 110 and the implement-interfacing segment openings 106 and be locked into place.

This provides another level of security and locks the boom-interface segment 52 and the implement-interfacing segment 54 together.

In Step 906, the load 22 is attached to the implement 16. In some embodiments described above, the load 22 may be attached to an implement 16 such as the material handler 20. The load 22 may be supported from underneath by forks 72 comprising of the material handler 20 and the load 22 may be secured with rope, nylon, metal, or any other attachment method that may be used to secure the load 22 to the material handler 20.

In a Step 908, the implement 16, which is attached to the implement-interfacing segment 54 and supporting the load 22 from below with the forks 72, is raised by the boom assembly 18. In some embodiments, the boom assembly 18 may be controlled by an operator at the utility vehicle 14, in the utility platform 140, or remotely. The operator may use controls 144 to control the boom assembly 18 and the orientation of the implement 16. In some embodiments, a worker in the utility platform 140 attached to the boom assembly 18 may control the boom assembly 18 raising the material handler 20 to a location where work is to be performed.

In a Step 910, the working action is performed. In some embodiments described above, the working action is mounting the load 22 to a structure other than the implement 16. For example, the sign 24 is mounted on a sign post 38 at an aerial location below the header 40. The location may have limitations such that the sign 24 may not be supported from above such as in a crane-like configuration. The sign 24 is supported from below by the material handler 20 and the sign 24 is attached to the sign post 38.

In a Step 912, the implement 16 is lowered and decoupled. Once the working action is performed, the implement 16 is lowered by controlling the boom assembly 18 and the implement 16. Once the implement 16 is lowed and safely secured on the ground or on the utility vehicle 14, the implement 16 is decoupled from the boom assembly 18. This is performed by removing the retaining pins 102, depressing the securing pins 98, and controlling the boom assembly 18 with boom-interfacing segment 52 attached, away from the implement 16, including the implement-interfacing segment 54.

In a Step 914, once decoupled, the implement 16 may be configured for storage and/or transport. For example, the implement 16 may be stored on the utility vehicle 14 for transport. The implement 16, in the case of the material handler 20, may be reconfigured by detaching components such as the forks 72, the backrest 82, the carriage 74, or any other components and storing the components separately or together.

In some embodiments, the material handler 20 folds for storage and transport. The forks 72 may fold up to the carriage 74 and the backrest 82 may fold down or may be removed or fold back behind the carriage 74. Any combination of the described folds may be implemented for reconfiguration of the material handler 20.

In some embodiments, the steps described above may be rearranged, omitted, and new steps may be added. The order of the steps may be rearranged and in some embodiments changed and any embodiments described above may be incorporated into the steps of the method. For example, in some embodiments, the boom-interfacing segment 52 and the implement-interfacing segment 54 are attached prior to attaching the boom assembly 18. In another exemplary embodiment, the material handler 20 may be attached to the utility platform 140 and the utility platform 140 may be attached to the material handler 20. At any step provided above the material handler 20 may be coupled to the utility platform 140 by any method described herein.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A boom-mountable implement for supporting and raising a load comprising:
- at least one platform for supporting the load from below, wherein the at least one platform is configured to attach to a carriage supporting the at least one platform;
- an adapter for attaching the carriage to a boom, wherein the adapter comprises a boom-interfacing segment attached to the boom and an implement-interfacing segment attached to the carriage,
- wherein the boom-interfacing segment comprises at least one attachment for attaching to the implement-interfacing segment; and
- a backrest secured to the carriage, positioned above the at least one platform for supporting the load when the boom-mountable implement is in a tilted position,
- wherein the backrest is distinct from the at least one platform,
- wherein the backrest comprises:
  - a solid flat front surface oriented perpendicularly to a platform top surface of the at least one platform and aligned coplanar with a platform vertical surface of the at least one platform;
  - at least one opening on a vertical side of the backrest for securing the load to the boom-mountable implement; and
  - a top surface positioned above the carriage.

2. The boom-mountable implement of claim 1,
- wherein the load is secured to the carriage, and
- wherein the at least one platform is tilted such that the load rests against the backrest of the implement.

3. The boom-mountable implement of claim 1, wherein the at least one platform supports a sign that is configured to be attached to a sign post.

4. The boom-mountable implement of claim 1, wherein the at least one platform comprises at least one fork; and
- wherein the at least one fork is laterally adjustable along a width of the carriage to support a size and a shape of the load,
- wherein the at least one fork is secured to the carriage with at least one hook.

5. The boom-mountable implement of claim 1, wherein the implement is configured to rotate about at least one axis.

6. The boom-mountable implement of claim 1, wherein the backrest further comprises:
- a hoop attached to the top surface of the backrest for securing the load to the boom-mountable implement or securing the boom mountable implement to a utility vehicle.

7. The boom-mountable implement of claim 1,
- wherein the implement is a utility platform,
- wherein the implement-interfacing segment of the adapter is attached to the utility platform.

8. The boom-mountable implement of claim 1, wherein the boom-interfacing segment is configured with an upper plate configured in a wedge-shape to insert into a wedge-shaped recess of the implement-interfacing segment to support the implement-interfacing segment and the implement.

9. The boom-mountable implement of claim 8, wherein the boom-interfacing segment is secured by securing pins that automatically extend from the implement-interfacing segment below the boom-interfacing segment when the upper plate is inserted into the wedge-shaped recess of the implement-interfacing segment.

10. The boom-mountable implement of claim 9, wherein the boom-interfacing segment is further secured to the implement-interfacing segment by manually inserting at least one retaining pin through at least one opening in the boom-interfacing segment and through at least one opening in the implement-interfacing segment.

11. A boom-mountable implement for supporting and raising a load comprising:

a platform for supporting the load from below, wherein the platform is configured to attach to a utility platform, wherein the platform is configured to be adjustable to receive and support the load, wherein the utility platform is configured to be raised by a boom such that the load is raised to a particular height; and an adapter for attaching the utility platform to the boom, wherein the adapter comprises a boom-interfacing segment attached to the boom and an implement-interfacing segment attached to the utility platform, wherein the boom-interfacing segment is secured by securing pins that automatically extend from the implement-interfacing segment below the boom-interfacing segment when an upper plate of the boom-interfacing segment is inserted into a wedge-shaped recess of the implement-interfacing segment.

12. The boom-mountable implement of claim 11, wherein the platform comprises at least one load peg for supporting the load thereon, wherein the at least one load peg is attached to a base of the utility platform.

13. The boom-mountable implement of claim 12, wherein the load peg comprises an inner load peg and an outer load peg and the inner load peg is telescopically adjustable in and out of the outer load peg.

14. The boom-mountable implement of claim 13, wherein the load is secured by attaching the load to the utility platform.

15. The boom-mountable implement of claim 14, wherein the utility platform is rotatable about at least one axis.

16. A boom-mountable implement for raising a load, comprising:

a boom-interfacing segment attached to a boom, wherein the boom is configured to raise the boom-mountable implement;

an implement-interfacing segment configured with a recess for receiving the boom-interfacing segment;

a carriage attached to the implement-interfacing segment;

at least one fork configured for supporting a load from below, wherein the at least one fork is attached to the carriage; and a backrest secured to the carriage, positioned above the at least one fork for supporting the load when the boom-mountable implement is in a tilted position, wherein the backrest is distinct from the at least one fork, wherein the backrest comprises:

a solid flat front surface oriented perpendicularly to a fork top surface of the at least one fork and aligned coplanar with a vertical surface of the at least one fork;

at least one opening on a vertical side of the backrest for securing the load to the boom-mountable implement; and a top surface positioned above the carriage.

17. The boom-mountable implement of claim 16, wherein the backrest further comprises:

a hoop attached to the top surface of the backrest for securing the load to the boom-mountable implement or securing the boom mountable implement to a utility vehicle.

18. The boom-mountable implement of claim 16, wherein the at least one fork is configured with at least one pad to act as a buffer between the at least one fork and the load.

19. The boom-mountable implement of claim 16, wherein a wedge-shaped plate of the boom-interfacing segment is configured to be inserted into the recess of the implement-interfacing segment and the implement-interfacing segment is supported by the boom-interfacing segment when raised.

20. The boom-mountable implement of claim 16, further comprising securing pins for securing the boom-interfacing segment from below, wherein the securing pins depress into the implement-interfacing segment upon contact with the boom-interfacing segment and extend to secure the boom-interfacing segment when the wedge-shaped plate of the boom-interfacing segment is inserted into the recess of the implement-interfacing segment.

* * * * *